US007866129B2

(12) United States Patent
Mansuino

(10) Patent No.: US 7,866,129 B2
(45) Date of Patent: Jan. 11, 2011

(54) DEVICE AND METHOD FOR PRODUCING PACKAGES WITH AT LEAST ONE TWISTED END

(75) Inventor: Sergio Mansuino, Mondovi (IT)

(73) Assignee: Soremartec S.A., Arlon (BE)

( * ) Notice: Subject to any disclaimer, the term of this patent is extended or adjusted under 35 U.S.C. 154(b) by 168 days.

(21) Appl. No.: 12/296,450

(22) PCT Filed: Dec. 19, 2006

(86) PCT No.: PCT/IB2006/003823

§ 371 (c)(1),
(2), (4) Date: Oct. 8, 2008

(87) PCT Pub. No.: WO2007/122451

PCT Pub. Date: Nov. 1, 2007

(65) Prior Publication Data

US 2009/0158690 A1 Jun. 25, 2009

(30) Foreign Application Priority Data

Apr. 20, 2006 (IT) ..... TO2006A0295

(51) Int. Cl.
*B65B 7/12* (2006.01)

(52) U.S. Cl. ..... 53/483; 53/461; 53/549; 53/227; 53/284

(58) Field of Classification Search ..... 53/483, 53/549, 227, 225, 234, 284, 217, 550, 455, 53/370, 430, 349, 459, 461
See application file for complete search history.

(56) References Cited

U.S. PATENT DOCUMENTS

| | | | | |
|---|---|---|---|---|
| 2,113,078 | A * | 4/1938 | Campbell | 53/409 |
| 4,014,156 | A * | 3/1977 | Klahn et al. | 426/279 |
| 4,429,513 | A * | 2/1984 | Beckers et al. | 53/547 |
| 4,517,786 | A | 5/1985 | Barker | |
| 5,016,421 | A | 5/1991 | Ferrero | |

FOREIGN PATENT DOCUMENTS

| | | |
|---|---|---|
| DE | 397302 | 7/1924 |
| DE | 1285941 | 12/1968 |
| DE | 2552600 A1 | 6/1977 |
| EP | 0802116 A1 | 10/1997 |
| WO | 02/06123 A1 | 1/2002 |
| WO | 02/22445 A1 | 3/2002 |

* cited by examiner

*Primary Examiner*—Hemant M Desai
(74) *Attorney, Agent, or Firm*—Rothwell, Figg, Ernst & Manbeck P.C.

(57) ABSTRACT

Described herein is a shuttle device for producing wrappers of sheet material (F) containing a product (P) with at least one fantail-twisted end obtained by twisting said sheet material (F). The shuttle (10) comprises a first part (112*a*, 112*b*) for receiving the product (P) located in the precursor of wrapper and at least one second part (212*a*, 212*b*; 312*a*, 312*b*) that grips on a respective part of precursor of wrapper (F). The first part (112*a*, 112*b*) and the second part (212*a*, 212*b*; 312*a*, 312*b*) of the shuttle (10) are able to turn with respect to one another about a given axis (X10) so as to produce at least one fantail-twisted end as a result of the twisting action imparted on the precursor of wrapper (F) following upon the relative movement of rotation about the aforesaid given axis (X10).

43 Claims, 6 Drawing Sheets

DEVICE AND METHOD FOR PRODUCING PACKAGES WITH AT LEAST ONE TWISTED END

CROSS REFERENCE TO RELATED APPLICATION(S)

This application is a 35 U.S.C. §371 National Phase Entry Application from PCT/IB2006/003823, filed Dec. 19, 2006, and designating the United States and also claims the benefit of Italian Patent Application No. TO2006A000295, filed Apr. 20, 2006, the disclosures of which are incorporated herein in their entirety by reference.

The present invention relates to techniques for making wrappers for foodstuff products, in particular wrappers of the type comprising at least one fantail-twisted end.

A typical example of wrapper of this type is represented by the wrapper commonly used for sweets or similar products, closed at least one end (hence either at one end or at both ends) by a fantail obtained by subjecting the sheet material of the wrapper to an action of twisting.

This is a wrapper that arose and has been developed adopting a traditional operation of wrapping carried out manually. In view of the vast popularity acquired over time, in the course of the years there has been devised and developed equipment that enables production of wrappers of this type in the framework of a totally automated production cycle. The corresponding technical literature is extremely extensive, as documented, at a patent level, by documents such as U.S. Pat. No. 5,016,421, by the corresponding priority cited previously and, more in general, by the existence of specific classification strings (e.g., B65B11/34 and connected ones) at the level of classification of patent documents.

The above are in general somewhat complex apparatuses, operating according to a cycle that envisages formation around the wrapped product (for instance, a sweet or lozenge) a precursor of an as a whole tubular wrapper, usually with open flaps. The precursor of wrapper thus formed is withheld in an area where the product is located and exposed to the action of one or two rotating grippers (according to whether it is desired to obtain one or else two fantail-twisted ends) which act on the end or ends of the wrapper by subjecting it/them to an action of twisting.

The complexity of the equipment is explained also considering that the aforesaid movement of gripping and twisting is performed with the grippers that "follow" the wrapper that advances to render the process faster and more efficient.

Other reasons of complexity of the equipment in question derive from the fact that the precursor of wrapper is made with a sheet of wrapping material (for example paper, aluminium, film of plastic material, combined aluminium/plastic material, etc.) cut out of a web that is fed into the machine.

All of these factors of course constitute a hindrance to the efficiency and rapidity of the production cycle.

Considerations not very different apply to alternative solutions already proposed in the art: see, for example, the document No. EP-A-0 802 116, where the movement of twisting is imparted, keeping the end part or parts of the precursor stationary and controlling rotation of the body of the precursor itself, i.e., the part where the product is located.

For all these reasons there has already been extensively applied the solution of replacing, also in wrapping of products such as sweets, lozenges, or pralines, the traditional sweet wrappers with wrappers of the type commonly referred to as "flow-pack" wrappers.

In addition to being suited for application with an "in-line" process (in this regard overcoming an intrinsic limit presented, for example, also by the solution described in the document No. WO-A-02/06123), the above latter solution presents the further advantage of enabling hermetic sealing of the individual wrapper, a result that cannot be obtained, for example, by the solution described in the document No. WO-A-02/22445, which gives rise to a sort of fold that resembles a fantail-twisted end.

The object of the present invention is to provide a solution that will enable fantail wrappers to be obtained in the context of a fast and efficient process, with the added possibility of using wrapping machines that are structurally much simpler than the wrapping machines for sweets and similar products currently in use and of preventing the multiple passages of products between successive gripping heads, with consequent possible aesthetic damage and problems of quality of the product.

According to the present invention, this object is achieved thanks to a shuttle device having the characteristics recited in the claims that follow. The invention also relates to a corresponding process, as well as to a corresponding apparatus.

The claims form an integral part of the disclosure of the invention provided herein.

The invention will now be described, purely by way of non-limiting example, with reference to the annexed plate of drawings, in which.

As basic consideration, it is emphasized that the description of an exemplary embodiment of the invention provided herein refers to a solution that enables wrappers with double fantail to be made for products such as sweets, lozenges or pralines, i.e., wrappers distinguished in that they have two fantail-twisted ends that extend on either side with respect to the central portion of the wrapper, where the confectionery product is received.

In other words it is thus a wrapper of the type commonly referred to as "sweet wrapper".

It is on the other hand well-known that it is possible to make sweet wrappers having just one fantail-twisted end, located on one side with respect to the portion of the wrapper where the confectionery product is received.

Figure 1:
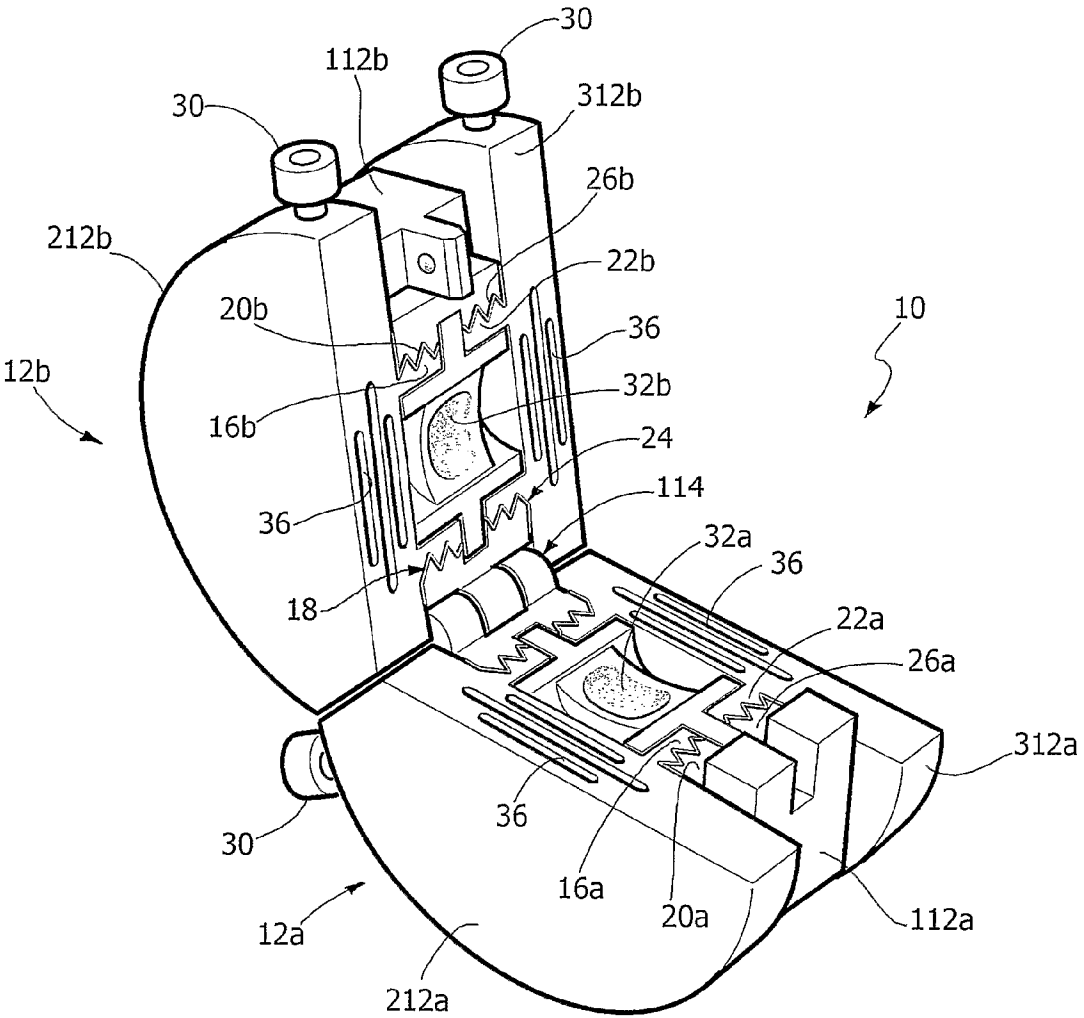
FIG. 1 is a general perspective view of a device that can be used in the context of the method and apparatus according to the invention, illustrated in the open position.
Figure 2:
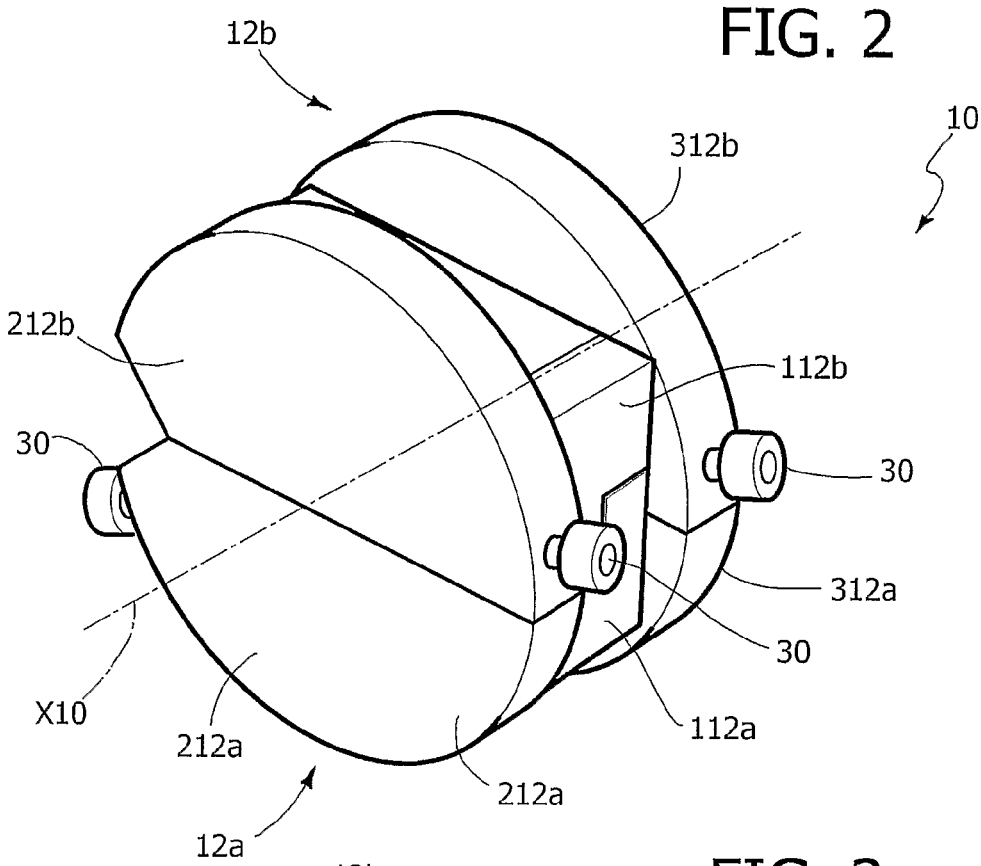
FIGS. 2 and 3 are two further views of the device of FIG. 1, illustrated in the closed condition, with reference to two possible positions of operation.
Figure 3:
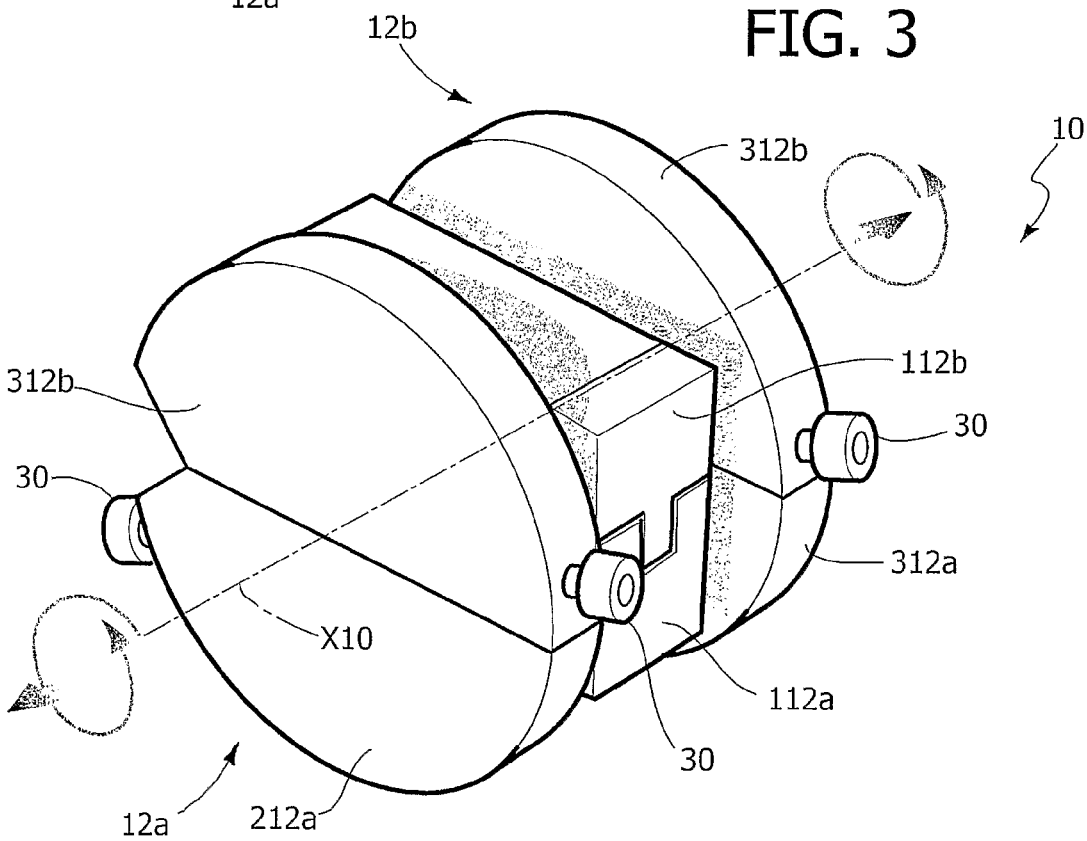

In the case where the formation of sweet wrappers having just one fantail-twisted end is envisaged, the structure of the device illustrated in FIGS. 1 to 3 may be simplified in the terms clarified more fully in what follows.

In the figures of the annexed plate of drawings, the reference number 10 designates as a whole a device (shuttle), to which, in the framework of the method and plant described herein, there can be entrusted the task of making each time a sweet wrapper for a respective product P.

Basically, the "shuttle" 10 is constituted by two parts 12*a*, 12*b* connected to one another (according to the modalities described in greater detail in what follows) so as to have a capacity of relative orientation according to a general book-like arrangement.

In particular, FIG. 1 illustrates the shuttle 10 with the two parts 12*a*, 12*b* divaricated in an open condition (the size of the angle of opening, usually greater than 90°, is not in itself critical). FIGS. 2 and 3 illustrate, instead, the shuttle 10 in closed conditions.

Each of the parts 12*a* (respectively, 12*b*) is in turn constituted by three elements, namely:

a central element 112*a* (respectively, 112*b*);

a first side element 212*a* (respectively, 212*b*); and a second side element 312*a* (respectively, 312*b*).

What has been said above applies in the case of the example of embodiment illustrated herein (which, it is recalled, is nothing more than an example), in which the aim is to make sweet wrappers provided with two fantail-twisted end parts. In the case where the aim is to make wrappers provided with just one fantail, one of the side elements (212*a*, 212*b* or, alternatively, 312*a*, 312*b*) is absent.

The fact that reference is made to one of the end elements in actual fact mentioning two components (i.e., the pair of elements 212*a*, 212*b* or else the pair of elements 312*a*, 312*b*) highlights the fact that, in each of the parts 12*a*, 12*b* of the shuttle 10, the two central parts 112*a*, 112*b* (coupled to one another with a hinge connection represented by the elements designated by 114) each carry coupled thereto a part of each of the elements 212*a*, 212*b* and 312*a*, 312*b*.

Furthermore, in the example of embodiment illustrated herein (which, we recall, is only an example), each of the elements 212*a*, 212*b* and 312*a*, 312*b* is semicircular in shape. This means that the side part or parts of the shuttle 10 is/are configured in fact as wheels. The same applies also to the possible developments of embodiment described in greater detail in what follows with reference to FIGS. 12 and 13, in which the side part or parts of the shuttle 10 comprise a series of spherical wedges.

As will be seen in greater detail in what follows, the choice of this particular conformation is useful in the case where, to control the relative movement of the side parts of the shuttle 10 with respect to the central part of the shuttle itself, it is desired to use the co-operation of an engagement element (e.g., cam-follower, pinion gear) carried by the shuttle 10 that advances, said element interacting with a fixed formation (cam, linear toothing, etc.).

The choice of this particular conformation is not, however, imperative for the purposes of implementation of the idea underlying the invention: the central part and the side parts of the shuttle 10 can in fact be of any shape whatsoever.

Within each of the parts 12*a*, 12*b*, the central element 112*a*, 112*b* is then connected to each of the side elements 212*a*, 212*b* and 312*a*, 312*b* (hereinafter reference will be made to the configuration of the shuttle 10 used for making wrappers with two fantail-twisted ends) via a respective tenon element.

Each of the tenons in question has a semi-cylindrical shape, i.e., that of a bent tile (being in general hollow) and defines, together with the tenon carried by the homologous element, a cylindrical pin or shank designed to co-operate with a corresponding cylindrical internal screw.

In the detail of the example of embodiment illustrated herein, the side element 212*a* carries a tenon element 16*a*, whilst the side element 212*b* also carries a tenon element 16*b*. The two tenon elements 16*a*, 16*b* form together an externally threaded cylindrical shank (see the external thread designated by 18) designed to co-operate with a corresponding cylindrical internal screw defined by two semi-cylindrical cavities 20*a*, 20*b* provided in the body of the central element 112*a*, 112*b*.

In a symmetrical and complementary way, the 10 elements 312*a* and 312*b* carry respective hollow semi-cylindrical tenon elements 22*a*, 22*b*, which can define together an externally threaded cylindrical pin or shank (see the thread designated by 24) designed to co-operate with a corresponding cylindrical internal screw defined by two semi-cylindrical cavities 26*a*, 26*b* provided in the body of the central element 112*a*, 112*b*.

Of course, the tenon elements 16*a*, 16*b* and 22*a*, 22*b*, having the shape of a cylindrical bent tile, give rise—in pairs—to a threaded cylindrical pin or shank when the respective end elements 212*a*, 212*b* and 312*a*, 312*b* are carried into the position of closing represented in FIGS. 2 and 3. Altogether similar considerations evidently apply to the corresponding internal screws 20*a*, 20*b* and 26*a*, 26*b*.

The modalities of definition of the pitch of the threads of the aforesaid threaded pins or shanks and of the corresponding internal screws will be discussed more extensively in what follows. For the present purpose, it will be sufficient to note that, when the shuttle 10 is brought into a closed condition (see FIGS. 2 and 3), the presence of the aforesaid pin/internal screw threaded couplings means that a movement of rotation imparted on each of the set of external elements 212*a*, 212*b* (on one side) and 312*a*, 312*b* (on the other) is such as to cause said sets to approach one another or move away from one another (according to the direction of rotation) with respect to the central body 112*a*, 112*b*.

The reference numbers 30 designate as a whole cam-follower elements (typically rollers or bearings mounted at the distal ends of pins projecting from the elements 212*a*, 212*b* and 312*a*, 312*b*), which have the purpose of imparting on the elements 212*a*, 212*b* and 312*a*, 312*b* an orderly movement of rotation according to the modalities described in greater detail in what follows.

To simplify the description, is will be assumed henceforth that the shuttle 10 is present in general in the form of a parallelepipedal central body or part 112*a*, 112*b*, on which the elements 212*a*, 212*b* and 312*a*, 312*b* (of a circular, i.e., disk-like shape) are mounted, with possibility of rotation about a principal axis X10.

The remainder of the description will, on the other hand, enable persons skilled in the art to realize that (as, on the other hand, has already been said) said specific geometrical configuration is not in itself imperative for the purposes of the embodiment of the solution described herein. Reference to this particular geometry has, however, the advantage of simplifying considerably the description of the method and plant presented herein, it being evident that the considerations made with reference to said simplified geometry can be readily extended to geometries of a different type, for example to a shuttle 10 having a shape different from the parallelepipedal one with square cross section and/or to solutions in which the rotation of the external elements of the shuttle 10 is performed about different axes, for instance axes that are parallel to, but not coincident with, the axis X10.

Figure 6:
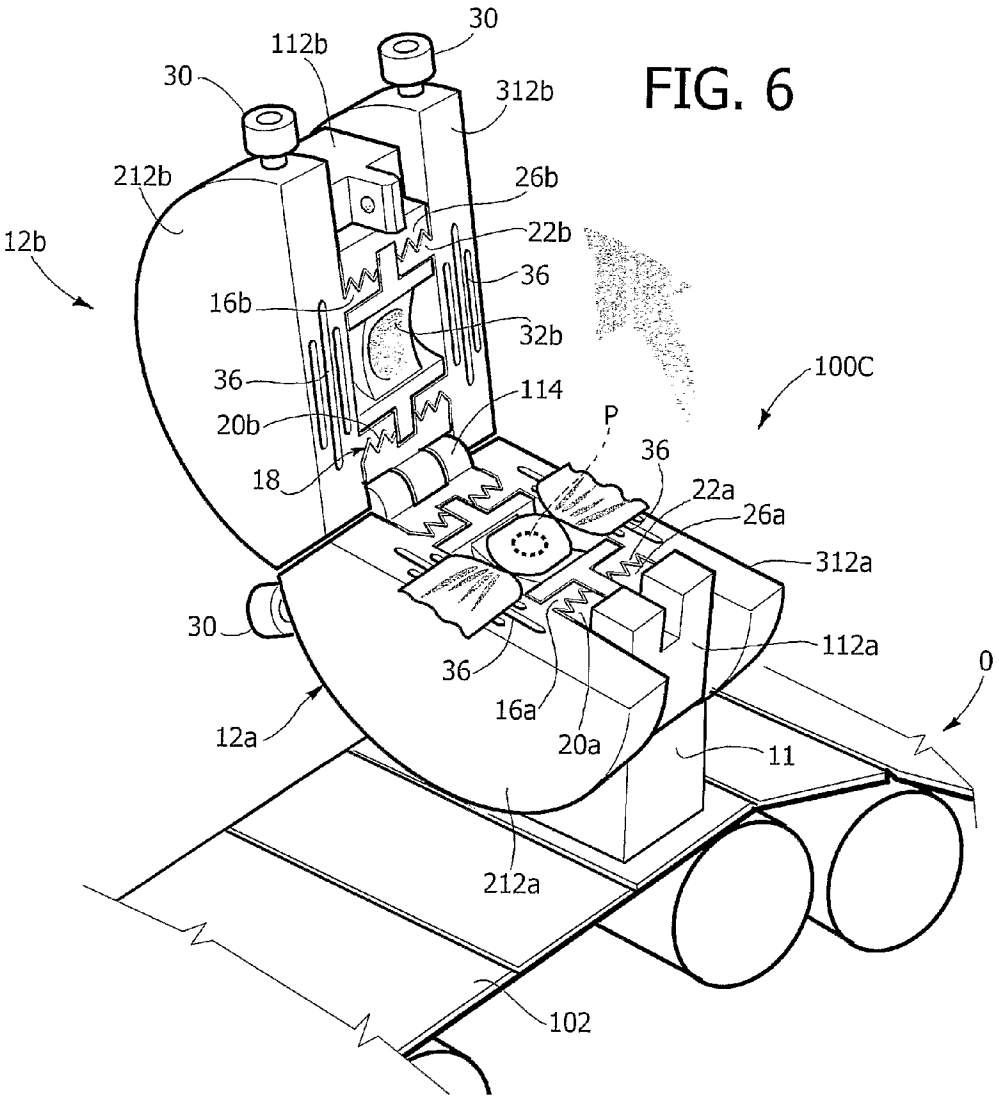

In order to facilitate understanding of the solution described herein, brief reference may be made first of all to FIG. 6. Here, a product P is represented, set in a sweet wrapper with two fantail-twisted ends, shown in its ideal position within the shuttle 10, which has just been opened to enable discharge (usually by gravity, as will be seen in greater detail in what follows) of the wrapped product. In particular, it will be appreciated that the product P that is located in the wrapper occupies a central position in the part 112*a*, 112*b*, it being at least partially received in cavities or niches 32*a*, 32*b* (see also FIG. 1), which can exert a sort of mild action of gripping on the product P when the shuttle 10 is brought into a closed position.

Clearly visible in FIG. 6 is the final conformation of the two fantail-twisted ends obtained by twisting at the two end elements 212*a*, 212*b* and 312*a*, 312*b*. For reasons of clarity, the configuration of parts as shown in FIG. 6 is the one that is to be reached at the end of the process described herein, when the shuttle 10 is opened to enable extraction of the wrapped product that is located inside it. Anticipating the presentation of this configuration appears, however, advantageous for the purposes of illustration of the process and apparatus, to which FIGS. 4 to 6 refer in greater detail.

Figure 7:
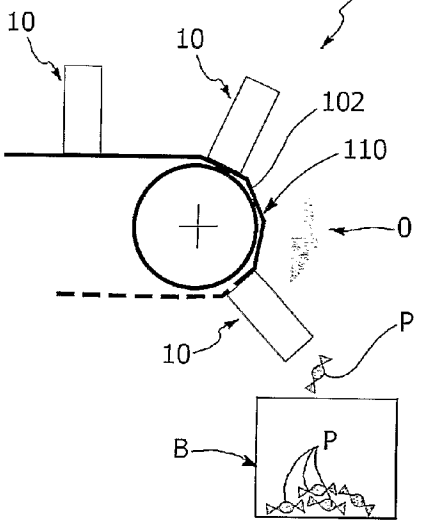
FIG. 7 is a schematic illustration of the final stretch of apparatus described herein.

In general, the apparatus in question comprises three cascaded stretches, designated, respectively, by 100A (FIG. 4), 100B (FIG. 5), and 100C (FIGS. 6 and 7), and is equipped with a certain number of shuttles 10, which are moved according to a closed-loop path by a motor mechanism, such as, for example, a motor-driven belt or track 102.

As a result of the traction exerted by the track 102 (or similar traction mechanism, such as for example one or more motor-driven wheels of the type described in the document No. WO-A-02/22445, already cited previously, or else a chain or a set of chains, all of which being motor-drive solutions that are well-known in the field of wrapping plants, in particular for foodstuff products), each shuttle 10 is arranged so as to traverse cyclically a closed-loop path that by and large comprises an active branch and a return branch. The active branch extends between:

an input position I (FIG. 4), where each shuttle 10 receives inside it a product P on a stretch of sheet of wrapping material that is to wrap the product P; and an output position O (FIGS. 6 and 7), where the individual shuttle 10, previously closed around the product and the wrapping material, is finally opened to enable extraction of the wrapped product, which usually drops back into an underlying collector, designated by B.

The return branch starts, instead, from the output position O, i.e., the position of discharge of the wrapped product, and brings the shuttles 10 back to the input position I, where each of them receives a new product P to be wrapped.

Persons skilled in the sector of wrapping and packaging plants will appreciate that the representation of the assembly and driving of the shuttles 10 by the track 102 is deliberately simplified. In particular, the shuttles 10 are herein mounted on prismatic bases 11, each fixed (for example, by screwing) on a pad or plate of the track 102. This choice aims at highlighting the fact that, for the construction of the element of traction represented here by the belt 102, it is possible, also in relation to the modalities of (possibly temporary) fixing of the shuttles 10, to resort to a virtually infinite choice of alternative solutions.

Figure 4:
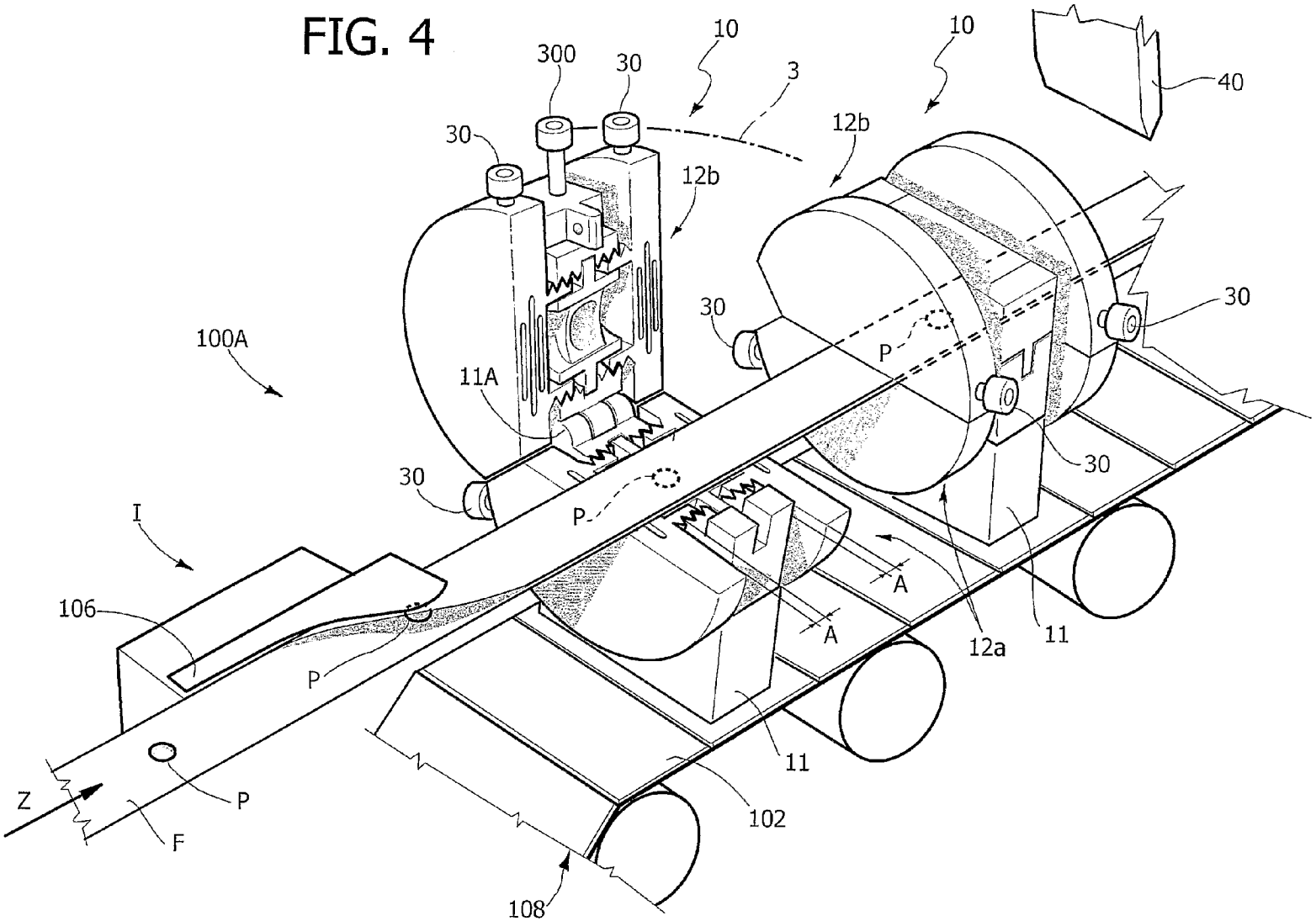
FIGS. 4 to 6 are perspective views of successive stretches of apparatus of the type described herein.
Figure 5:
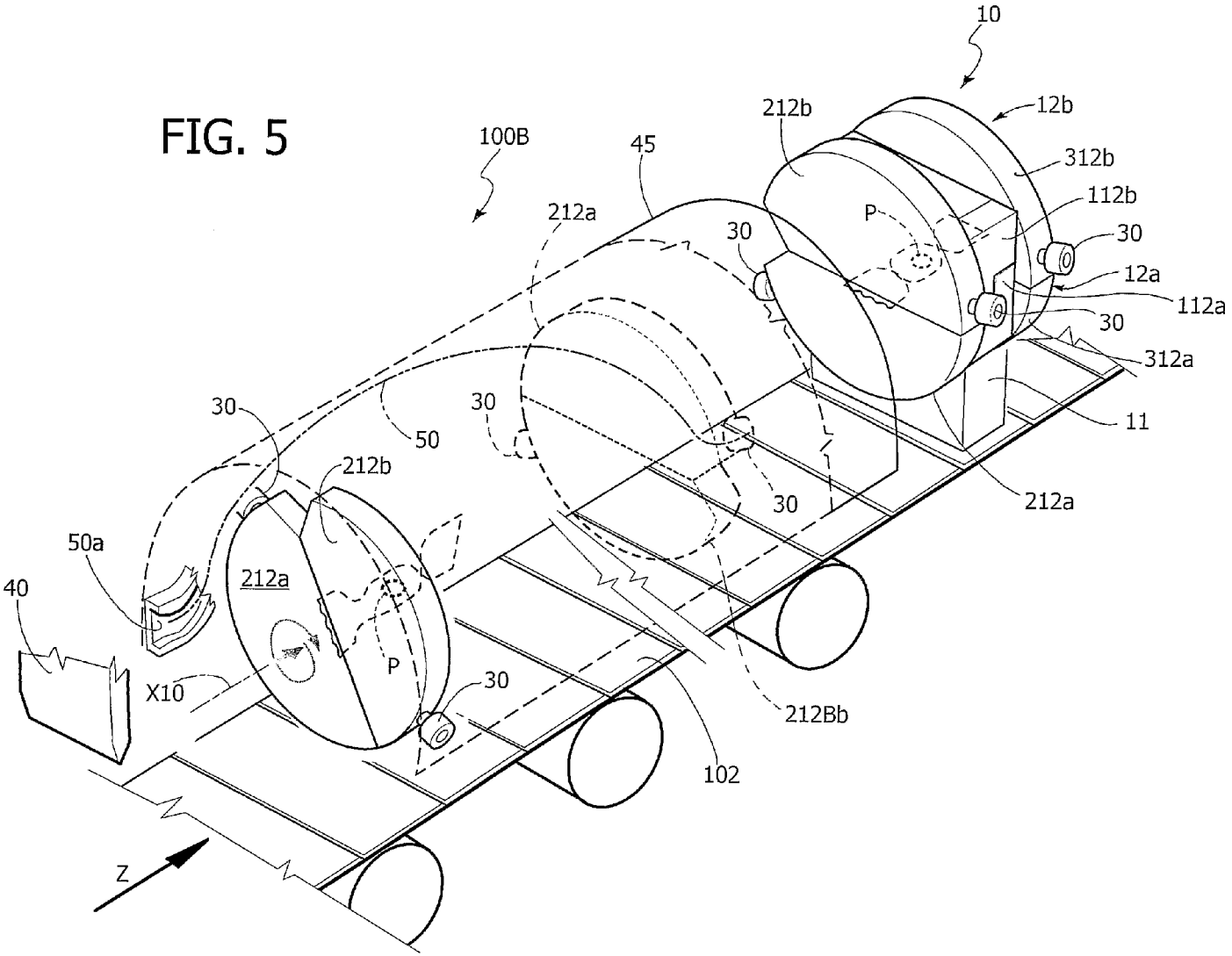

In the (currently preferred, but not imperative) embodiment illustrated herein, the apparatus 100A, 100B, 100C described enables the product P to be wrapped with a process that is performed as a whole "in line", i.e., with the shuttles 10 (which can be provided in any number, hence even some tens if not hundreds for each plant) that advance in procession with their axes X10 aligned with one another in their direction of advance (i.e., in the direction of advance of the active branch of the conveyor 102), designated by z in FIG. 5. The entire operation is performed with the direction of advance of the shuttles 10 that coincides also with the direction of feed of the product P and with the direction of feed of the sheet wrapping material F designed to receive them, as may immediately be appreciated from the part on the bottom left of FIG. 4, where said direction of feed of the product P and of the wrapping sheet is once again designated by z.

As has been said, this embodiment of the invention (axis of rotation X10 parallel to the direction of advance and of feed z) is the currently preferred one, but is not imperative. The solution according to the invention, and in particular the shuttles 10, is suited in fact to being used also in conditions in which, for example, the axis of rotation X10 is orthogonal to the direction of advance and of feed z.

In the feed or input part I of the plant 100, the products P advance in an orderly array (hence in general at constant distances apart), having been previously deposited on the sheet of wrapping material F. Said wrapping material F is here in the form of a continuous web, which is kept plane and then bent or folded when it reaches a shaping element 106, so as to form a precursor of wrapper having a general U-shaped or V-shaped conformation, which receives, in its bent or folded part, the product P (as before, reference is here made to lozenges, sweets or similar products, such as chocolates, nougat, etc.). Devices that enable supply of a weblike material, for depositing thereon an orderly array of products P of the type described, and formation of the subsequent U-shaped or V-shaped bends or folds in the sheet itself are well-known in the art of plants for automatic wrapping, in particular of foodstuff products, which renders altogether superfluous a more detailed description herein.

In this regard, it should again be noted that the choice of making the continuous precursor of wrapper in the form of a web bent to form a U with end flaps free that mate together is just one from among the possible solutions in the context of a plant of the type described herein.

Just to mention a possible alternative, the aforesaid precursor could be constituted by a tubular wrapper closed by a longitudinal sealing fin, within which the products P are inserted at regular distances. This solution basically corresponds to the solution commonly adopted to obtain wrappers of the type normally referred to as "flow-pack" wrappers. Also in this case, it is a technology that does not require a more detailed description, it being well-known in the sector of wrapping plants, in particular for wrapping foodstuff products.

Once again along the same lines, the aforesaid precursor could be constituted by a chain of wrappers containing the products P already wrapped in hermetic conditions (e.g., by cold and/or hot sealing), according to the criteria described, for example, in the document No. EP-A-1 477 423. In this case, the solution described herein is suited to providing the station designated by 20 in the drawings of EP-A-1 477 423.

The precursor of continuous wrapper with the products P positioned inside it converges with the movement of advance of the shuttles 10, which, at the input end I of the plant 100, are kept in an open position.

Assuming that the shuttles 10 are made to advance with a general movement of lifting determined by the presence of an ascending-ramp stretch 108 of the belt 102, the convergence of the aforesaid movements (performed in a synchronized way, i.e., in such a way as not to give rise to movements of relative advance or relative delay of the products P with respect to the shuttles 10) is such as to bring each product P to place itself in the central part 112*a*, 112*b* of a shuttle 10, in particular in the receiving "niches" 32*a* and 32*b* (FIG. 1).

Once this condition of operation is achieved, the shuttle 10 is reclosed (for example, by a pusher element of a known type, not illustrated, or by a cam system, in the terms described in greater detail in what follows) and brought into a position of firm closing. This can happen, for example, thanks to the presence of return springs associated to the hinges 114 (FIG. 1). A possible alternative is that of envisaging, among the various complementary elements of the booklike configuration 12*a*, 12*b* of the shuttle 10 return elements of a magnet type.

In these conditions, each shuttle 10 (note, for example the shuttle appearing on the right in FIG. 4) advances having enclosed inside it a product P (received in the two complementary cavities 32*a*, 32*b*) with two respective portions of wrapping material F, which are in turn bent or folded to form a U shape or a V shape and "pinched" between the end elements 212*a*, 212*b* and 312*a*, 312*b*.

In FIG. 1 there will be appreciated the possible presence of transverse ribs 36, designed—in the condition of operation described—to render firmer the gripping of the aforesaid end elements on the respective portion of sheet material F pinched between them.

Once again from an observation of the part on the bottom left of FIG. 4, it will be appreciated that, when the shuttles 10 are brought to the input end I of the plant 100, they are adjusted in a position such that the end elements 212*a*, 212*b* and 312*a*, 312*b* are located at a certain distance A (see FIG. 4) from the central part 112*a*, 112*b* of the shuttle 10.

The distance A is designed and determined so as to take into account the longitudinal shrinkage that is produced in the portion of wrapper that wraps each product P when the wrapper in question is subjected to a twisting action to obtain the fantail-twisted end.

In a cutting station designated by 40—for example, of the type with a blade having a vertical reciprocating motion—it is in fact envisaged that the sheet material F is subjected to segmentation (cutting to length) in such a way as to cause each shuttle 10 to take along with it a respective stretch of sheet material F with the end parts firmly pinched (also on account of the presence of the ribs 36) between the end elements 212*a*, 212*b* and 312*a*, 312*b* gripped to one another.

In said conditions, the sheet material F is not in general able to slide longitudinally (i.e., in the direction of the axis X10) with respect to the elements 212*a*, 212*b* and 312*a*, 312*b* that grip it like grippers. The longitudinal contraction of the length of wrapping material F resulting from the movement of twisting that leads to the formation of the fantail-twisted ends would thus result in a marked stress applied on the wrapping material, with consequent risk of tearing thereof.

In this regard, it should be taken into account that with a product of dimensions comparable to those of a small sweet or of a lozenge, the individual length of wrapping material F may have—prior to the formation of the fantail-twisted ends—a length of the order of some tens of millimetres. The formation of two fantail-twisted ends each obtained by twisting, for example, the sheet material F for one and a half turns (i.e., through an angle of 540°) about the axis X10, leads to a shortening at the level of finished wrapper, measured according to the overall length detected between the external edges of the fantail-twisted ends) of the order of some millimetres. This is in any case a reduction of the overall length in the region of 16-18%.

In principle, it would be possible to consider enabling said movement of longitudinal contraction of the length or stretch of wrapper F by allowing, at the end or ends thereof subjected to the movement of twisting, longitudinal sliding with respect to the end elements 212*a*, 212*b* and 312*a*, 312*b* of the shuttle 10.

Said sliding movement would in any case be induced by a longitudinal tensile stress exerted on the wrapping material (with consequent risk of tearing). Furthermore, the fact of enabling this movement of longitudinal sliding would involve rendering less firm the action of gripping of the end of the wrapper by the elements 212*a*, 212*b* and 312*a*, 312*b* that withhold it like grippers, with the risk of giving rise to undesirable movements of sliding that might jeopardize the quality of the fantail obtained (or even cause the end of the wrapper to escape the action of gripping exerted by the end elements 212*a*, 212*b* and 312*a*, 312*b* of the shuttle 10).

Once the cutting station 40 is exceeded, the action of which is such that each shuttle 10 will receive inside it a product P enveloped by a respective stretch or length of wrapping material F, the shuttles 10 advance through a set of tunnel-like overturning elements 45, which, by co-operating with the followers 30, bring about rotation of the end parts 212*a*, 212*b* and 312*a*, 312*b*, with consequent formation of the fantail-twisted ends of the wrapper.

In general, each of the overturning elements 45 in question forms a sort of tunnel traversed by the flow of the shuttles 10 drawn along by the track 102. Each element 45 carries inside it a channel or groove, designated by 50, which extends according to an arched path and which, starting from an input end 50*a* situated on one side of the path of advance of the shuttles 10 approximately in a position corresponding to the plane of extension of the belt or track 102, rises gradually until a culminating position is reached with respect to the path of advance of the shuttles 10 (in effect, confusable with the axis X10) and then drops gradually again towards the plane of the belt 102.

In particular, FIG. 5 shows (in the part furthest to the left) a pair of elements 212*a*, 212*b* (but the same would apply also to a pair of elements 312*a*, 312*b*), which carry, on the left-hand side, as viewed in the drawing, a cam-follower roller 30. The follower element 30 in question has entered the groove/cam 50 in a position corresponding to an end 50*a* thereof located on the left-hand side of the base of the mouth of the tunnel 45 and, as a result of the movement of advance of the corresponding shuttle 10 through the tunnel 45, has started to rise along the cam 50 (see the path represented by the dashed-and-dotted line), inducing rotation of the pair of elements 212*a*, 212*b* in a clockwise direction, with the consequence of starting the movement of twisting of the end of wrapper pinched within them.

The movement of advance of the shuttle 10 through the tunnel 45 then brings the cam-follower roller 30 to reach the top of the path of the cam 50 and then drop back gradually on the right-hand side of the tunnel 45 until a position is reached in which the roller 30 disengages the groove/cam 50, after having imparted on the pair of elements 212*a*, 212*b* and on the end of wrapper pinched within them a movement of overturning/twisting through 180°.

As will be seen more clearly from what follows, it is also possible to cause the minimum amount of the movement of overturning/twisting to correspond to submultiples of 180°.

Said movement of overturning has carried another cam-follower element 30 situated in a position diametrally opposite into conditions to engage, according to the same modalities, a groove/cam 50 provided in a further tunnel-like overturning element 45, the aim being to impart on the pair of elements 212*a*, 212*b* and on the end of wrapper pinched within them a further movement of overturning/twisting through 180°.

It is here emphasized that, as will be seen more clearly from what follows, it is also possible to obtain the minimum amount of movement of overturning/twisting corresponding to submultiples of 180°.

Of course, what has been said here and illustrated in FIG. 5 with reference to a pair of elements 212*a*, 212*b* applies identically to a pair of elements 312*a*, 312*b* and to the end of wrapper pinched within them.

To resort to a terminology drawn from the world of aeronautics, it may be stated that the complex of movements described leads each end part 212*a*, 212*b* and 312*a*, 312*b* of a shuttle 10 to describe a barrel-roll movement, i.e., a screw-like movement with horizontal axis (X10), being drawn along in said movement by the action of the follower elements 30, which in turn describe, following the grooves/cams 50, a barrel-roll path, once again with a horizontal axis.

In general, each of the tunnel-like overturning elements 45 is able to produce a movement of overturning/twisting through an angle of 180°. This choice is dictated by the desire not to interfere with the movement of advance of the belt 102.

Consequently, to impart on each end part of the shuttle 10 a movement of rotation of 360° or 540° (one full turn or one and a half turns about the axis X10) it is usually necessary to have available two or three overturning elements 45 cascaded with respect to one another.

It will be appreciated, on the other hand, that each of the grooves/cams 50 is able to control the movement of rotation of both of the two end parts of a shuttle 10 being engaged in succession by the cam-follower elements 30 carried by said mobile parts.

The solution described herein amounts of course to just one of the many possible alternatives to which it is possible to resort in order to perform the movement of screwing of the end parts 212*a*, 212*b* and 312*a*, 312*b* of the shuttles 10 that underlies the formation of the fantail-twisted ends.

For instance, it is possible to install on each shuttle 10 a motor-drive (or a pair of motor-drives), for example in the form of brushless motors that drive mobile end parts 212*a*, 212*b* and 312*a*, 312*b* in rotation about the axis X10. The supply of said motors can be readily obtained through flexible conductors embedded in the traction belt 102.

With respect to the solution with cam actuation, to which extensive reference has been made previously, said alternative solution affords the advantage of enabling the movement of rotation of the end parts 212*a*, 212*b* and 312*a*, 312*b* about the axis X10 to be obtained without solution of continuity, i.e., through virtually any angle of rotation (for example, a rotation through 360° or 540° about the axis X10 performed in just one go).

As has already been said, the "in line" embodiment described herein, with axis of rotation X10 parallel to the direction z of advance of the shuttles 10 and of feed of the sheet F, is preferred, but not imperative. The solution according to the invention is suited in fact to being used also in conditions in which, for example, the axis of rotation X10 is orthogonal to the direction of advance and of feed z.

In this case, the condition of assembly of the shuttles 10 on the traction track 102 would be rotated through 90° with respect to the one illustrated herein, i.e., with the pairs of elements or end parts 212*a*, 212*b* and 312*a*, 312*b* that form a pair of side wheels on either side of the central part 112*a*, 112*b*.

In this case, the operation of controlling the movement of rotation of the end parts 212*a*, 212*b* and 312*a*, 312*b* with respect to the central part 112*a*, 112*b* about the axis is further facilitated. Once again, as in the case illustrated in FIG. 5, recourse is had to an engagement element mounted on the shuttle 10 and interacting with a fixed formation during advance of the shuttle 10.

In this case (i.e., with the axis X10 orthogonal to the direction z), it is sufficient to make the circular outer perimeter of the elements 212*a*, 212*b* and 312*a*, 312*b* as a pinion gear, which can mesh with linear toothings or racks arranged on the sides of the track 102, where it is desired to obtain the movement of overturning of the elements 212*a*, 212*b* and 312*a*, 312*b* and the resulting twisting of the ends of the wrapper pinched within them.

In this case (not specifically illustrated, in so far as it is readily understandable), the movement of overturning of the elements 212*a*, 212*b* and 312*a*, 312*b* and the resulting twisting of the ends of the wrapper pinched within them can be obtained without any interruption also on angular widths greater than 180°, carrying out also in this case, for example, a rotation of 360° or 540° about the axis X10 performed in just one go).

Furthermore, taking into account the fact that the movement of rotation of the end parts 212*a*, 212*b* and 312*a*, 312*b* about the axis X10 is in any case a relative movement with respect to the central part 112*a*, 112*b*, in which the product P is currently located, it is also possible to consider using a solution of movement complementary with respect to the one described, i.e., a solution in which the end parts 212*a*, 212*b* and 312*a*, 312*b* remain stationary, whilst the central part 12*a*, 12*b* rotates about the axis X10. In particular, by adopting this solution, a single (e.g., brushless) motor-drive set between one of the end parts 212*a*, 212*b* or else 312*a*, 312*b* and the central part 112*a*, 112*b* would be sufficient to perform a desired movement.

All these alternative solutions may in themselves be proposed, and as such included in the scope of the present invention. The experiments so far conducted by the present applicant lead, however, to considering said solutions as not preferred. Considering in general the field of application, it is desirable in fact for the shuttles 10 to preserve a structure that is as simple as possible (hence without any motor-drives being provided on board the shuttles 10), above all if it is taken into account that the aim is to enable the shuttles 10 to be made as moulded bodies with a structure that is as a whole simple, of contained cost (the choice of making the shuttles 10 as parts of moulded plastic material is currently considered preferential), with the consequent possibility of considering a periodic replacement of the shuttles 10 and again rendering extremely easy the operation of periodic cleaning (including washing) of the shuttles 10.

Once the desired movement of overturning/twisting is achieved, i.e., —with reference to the preferred example of embodiment illustrated herein—at the outlet of the tunnel-like overturning element 45 situated further downstream in the direction of advance of the shuttles 10, the shuttles 10 themselves can be brought into an open position so as to enable extraction of the wrapped products P that are located within them (see FIG. 6).

Usually the extraction of the wrapped products P is obtained simply by gravity in a collection container B located underneath a descending ramplike stretch 110, in which the belt 102 drops again downwards into a position corresponding to the output end O of the plant 100, producing turning upside down of the shuttles 10 into the open condition. Then the shuttles start to traverse the return stretch of the path that brings the shuttles 10 back towards the input or feed position I of the plant 100. As may be appreciated immediately from an examination of FIG. 6, when the shuttles have been brought back into an open position (with any opening device known in the art), they are set with the end parts 212*a*, 212*b* and 312*a*, 312*b* in a position generically close to the central part 112*a*, 112*b*, in so far as, following upon the movement of overturning imposed by the cams 50, and as a result of the presence of the threaded pins or shanks 16*a*, 16*b*, as well as 22*a*, 22*b*; and of the internal screws 20*a*, 20*b*, as well as 26*a*, 26*b*, the aforesaid end parts 212*a*, 212*b* and 312*a*, 312*b*, co-operating with said pins or shanks, which were before set at a distance A (FIG. 4), have approached the central part 112*a*, 112*b*. Usually this is obtained by causing the end parts 212*a*, 212*b* and 312*a*, 312*b* to move into a condition where they almost impinge upon the central part 112*a*, 112*b*, the position where they impinge completely being usually avoided in order not to give rise to undesirable phenomena of jamming.

The thread pitches of the threaded parts 16*a*, 16*b* and 22*a*, 22*b*, as well as 20*a*, 20*b* and 26*a*, 26*b*, are determined in such a way as to impart on the end parts 212*a*, 212*b* and 312*a*, 312*b* of the shuttle 10 a movement of approach to the central part 12*a*, 12*b* exactly corresponding to the shortening undergone by the respective ends of the wrapper as a result of the angular movement of twisting that leads to the formation of the fantail-twisted ends.

For example, in the case where it happens that, following upon a movement of rotation of one and a half turns (540°), each end of the wrapper approaches by 4 mm the central part where the product P is located, the pitch of the threads is calculated so as to correspond to 4 mm/540°.

Consequently, during movement of return from the output position O towards the input position I of the plant 10 (i.e., along the bottom branch of the traction belt 102), it is necessary to impart on the end parts of the shuttles 10 a movement of rotation opposite and of equal amount with respect to the one that has led to the formation of the fantail-twisted ends of the wrappers, so as to restore the initial conditions (distance A) represented in FIG. 4. Said movement of rotation can be obtained, after prior re-closing of the shuttles 10, according to modalities substantially analogous to the ones adopted for controlling the movement of screwing that determines the formation of the fantail-twisted ends.

The description provided previously with reference to the sequence of FIGS. 4, 5 and 6 lays particular emphasis on the possible modalities adopted to enable the movement of overturning of the external parts of the shuttle 212*a*, 212*b* and 312*a*, 312*b* (hence the movement of twisting of the outer parts of the wrapper). It will be appreciated in any case that substantially similar modalities can be adopted for controlling the movement of closing (FIG. 4) and of opening of the shuttles 10 (FIG. 6), respectively, before and after the movement of overturning of the external parts and the movement of twisting of the outer parts of the wrapper.

In a currently preferred embodiment, the shuttle 10 is "preloaded" in the direction of closing, in the sense that associated to the hinge 114 is a torsion spring (not explicitly visible in the drawings) that acts in the direction of forcing the two central parts 112*a* and 112*b* to close, at the same time possibly envisaging a "dead point" (reached with the two parts of the shuttle divaricated in an open position, as represented in FIG. 1), where the aforesaid spring is ineffective, so that the shuttle 10 spontaneously maintains the open position.

By adopting said solution, closing of the shuttle 10 (see median part of FIG. 4) can be simply obtained with a pusher or a cam C, the path of which is indicated by a dashed-and-dotted line in FIG. 4. The cam in question co-operates, for example, with a cam-follower 300, the profile of which is represented by a dashed line in just FIG. 4 and projects radially from the part 112*b* of the shuttle. The co-operation of the cam C and of the follower 300 (structurally identical to the followers 30) causes the shuttle to be forced closed beyond the aforesaid dead point, and from this point the shuttle 10 is closed under the action of the spring associated to the hinge 114.

The cam-follower 300 can then be used in the opening phase, when the shuttles 10 exit from the (last) overturning tunnel 45: a cam with a movement roughly resembling the movement of the cam 50 illustrated in FIG. 5, but with opposite orientation, slidably receives the follower 300, raising it and raising along with it, against the action of return of the spring associated to the hinge 114, the top part 112*b* of the shuttle 10, which is thus brought back into an open position.

The end parts 212*a*, 212*b* and 312*a*, 312*b* of the shuttle 10 can be readily kept aligned and fixed with respect to the central parts 112*a* and 112*b* during the aforesaid movement of opening and closing thanks to cams, magnets, and/or mobile pins that act between the central parts 112*a* and 112*b* and the end parts 212*a*, 212*b* and 312*a*, 312*b* of the shuttle 10.

Figure 8:
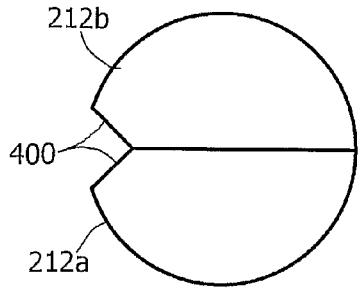
FIGS. 8 to 13 illustrate some possible developments of embodiment of the solution described herein.
Figure 9:
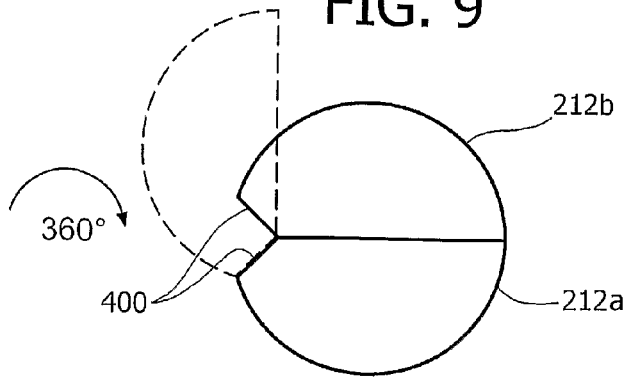

FIGS. 8 and 9 of the annexed drawings are aimed at rendering more readily understandable the fact that, by configuring the elements forming the end parts 212*a*, 212*b* and 312*a*, 312*b* according to the criteria illustrated (for reasons of simplicity) in FIGS. 1 to 6, i.e., with each element of semicircular shape with two end chamfers 400, it is in general possible to open the shuttle 10 only in a position corresponding to angular positions of the end parts 212*a*, 212*b* and 312*a*, 312*b* separated by angles of rotation equal to 360° or multiples of 360°.

Figure 10:
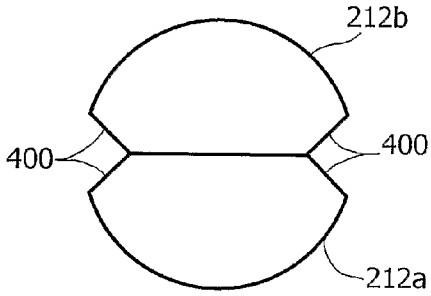
Figure 11:
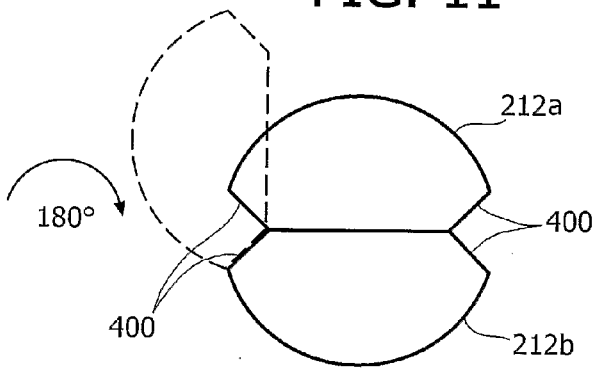

Maintaining the semicircular shape, but providing chamfers 400 at both ends of each element, as illustrated in FIGS. 10 and 11, it is in general possible to open the shuttle 10 only at angular positions of the end parts 212*a*, 212*b* and 312*a*, 312*b* separated by angles of rotation equal to 180° or multiples of 180°, i.e., when the straight edges of the elements in question are aligned with the plane faces of the central parts 112*a* and 112*b*.

Figure 12:
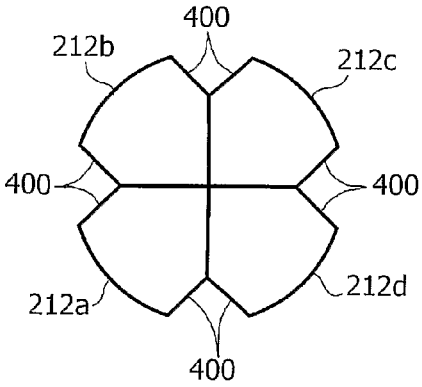
Figure 13:
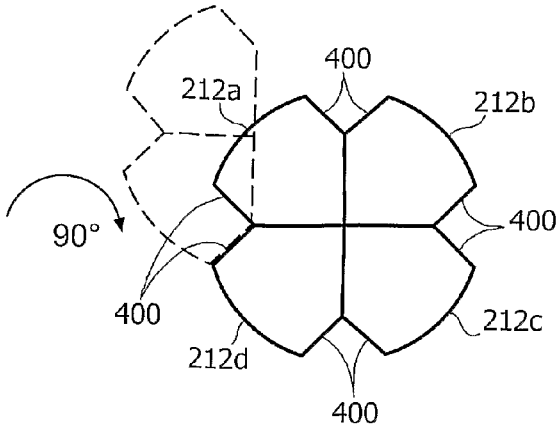

More in general (also irrespective of the chamfers 400, the presence of which is merely dictated by the specific proportions of the elements illustrated herein; in other words, by choosing other proportions, the chamfers 400 could be eliminated) it will be appreciated that, providing the end parts 212*a*, 212*b* and 312*a*, 312*b*, not in the form of two semicircular elements, but in the form of a larger number of "wedges" (for example, four wedges 212*a*, 212*b*, 212*c*, 212*d*, each having an angular extension equal to 90°, as illustrated in FIGS. 12 and 13), it is possible to discretize more finely the movement of overturning of the end parts of the shuttle 10 and, consequently, the movement of twisting of the fantail ends of the wrapper.

For instance, the sequence of FIGS. 12 and 13 explains how, by using four wedges 212*a*, 212*b*, 212*c*, 212*d* of angular width equal to 90°, it is possible to impart on the external parts of the shuttle (and hence at the fantail-twisted ends of the wrapper obtained) movements of angular width equal to any multiple of 90°, in the knowledge that it is possible in any case to open and close the shuttle 10 before/after the movement in so far as there are always and in any case available straight edges of the wedges 212*a*, 212*b*, 212*c*, 212*d* aligned with the plane faces of the central parts 112*a* and 112*b*.

The principle can be extended; for example, by using eight wedges of angular width equal to 45° it is possible to impart on the external parts of the shuttle (and hence on the fantail-twisted ends of the wrapper obtained) movements of angular width equal to any multiple of 45° and so forth.

Of course, without prejudice to the principle of the invention, the details of construction and the embodiments may vary widely with respect to what is described and illustrated herein, without thereby departing from the scope of the invention, as defined in the annexed claims.

The invention claimed is:

1. A shuttle device for producing wrappers of sheet material containing a product with at least one fantail-twisted end obtained by twisting said sheet material, said shuttle comprising a first part for receiving said at least one product received in a precursor of wrapper and at least one second part that grips on a respective part of said precursor of wrapper, said at least one second part of said shuttle being able to turn with respect to said first part, about a given axis so as to produce said at least one fantail-twisted end as a result of the twisting action imparted on said precursor of wrapper resulting from said relative movement of rotation about said given axis, wherein said shuttle comprises a screw coupling between said first part and said at least one second part so that, during said relative movement of rotation about said axis that produces the formation of said fantail-twisted end, said first part and said at least one second part of said shuttle approach one another so as to compensate for the shortening of said precursor of wrapper resulting from said twisting action.

2. The shuttle according to claim 1, characterized in that it comprises:

a coupling element for coupling to a driving member for moving said shuttle in a given direction of advance; and motor elements for imparting on said first part and on said at least one second part of said shuttle said relative movement of rotation about an axis parallel to said given direction of advance.

3. The shuttle according to claim 1, characterized in that it comprises:

a coupling element for coupling to a driving member for moving said shuttle in a given direction of advance; and motor elements for imparting on said first part and on said at least one second part of said shuttle said relative movement of rotation about an axis orthogonal to said given direction of advance.

4. The shuttle according to claim 1, characterized in that at least one between said first part and said at least one second part carries associated thereto at least one engagement element, which can interact with a fixed formation during movement of said shuttle for controlling said relative movement of rotation about said axis.

5. The shuttle according to claim 4, characterized in that said engagement element is a cam-follower element.

6. The shuttle according to claim 4, characterized in that said engagement element is a pinion gear.

7. The shuttle according to claim 6, characterized in that said pinion gear is constituted by the contour of said at least one second part of the shuttle.

8. The shuttle according to claim 1, characterized in that mounted on at least one between said first part and said at least one second part of said shuttle is a motor element for controlling said relative movement of rotation about said axis.

9. The shuttle according to claim 1, characterized in that said screw coupling is formed by tenon parts and complementary threaded cavities carried by said first part and said at least one second part of the shuttle.

10. A shuttle device for producing wrappers of sheet material containing a product with at least one fantail-twisted end obtained by twisting said sheet material, said shuttle comprising a first part for receiving said at least one product received in a precursor of wrapper and at least one second part that grips on a respective part of said precursor of wrapper, said at least one second part of said shuttle being able to turn with respect to said first part, about a given axis so as to produce said at least one fantail-twisted end as a result of the twisting action imparted on said precursor of wrapper resulting from said relative movement of rotation about said given axis wherein said shuttle has a general booklike structure that enables:

an open position, for receiving said precursor of wrapper, and a closed position, in which the precursor of wrapper with a product inside it is gripped in said shuttle.

11. The shuttle according to claim 10, characterized in that it carries associated thereto at least one engagement element, which can interact with a fixed formation during movement of said shuttle for producing the passage of said booklike structure between said open position and said closed position.

12. The shuttle according to claim 11, characterized in that said engagement element is a cam-follower element.

13. The shuttle according to claim 10, characterized in that it comprises means of elastic return of said booklike structure into at least one between said open position and said closed position.

14. The shuttle according to claim 13, characterized in that said booklike structure comprises a hinge and in that said means of elastic return are associated to said hinge.

15. The shuttle according to claim 10, characterized in that said at least one second part of said shuttle comprises distinct elements that separated from one another when said shuttle is in an open position.

16. The shuttle according to claim 15, characterized in that said at least one second part of said shuttle comprises a pair of distinct elements that separated from one another when said shuttle is in an open position, so that said shuttle can be opened into said open position in positions of said relative movement of rotation about said given axis separated from one another by 180° or multiples of 180°.

17. The shuttle according to claim 15, characterized in that said at least one second part of said shuttle comprises a plurality of wedges of angular width equal to a submultiple of 180°, which are separated from one another when said shuttle is in an open position, so that said shuttle can be opened into said open position in positions of said relative movement of rotation about said given axis separated from one another by one or more submultiples of 180°.

18. A method for producing wrappers of sheet material containing a product with at least one fantail-twisted end obtained by twisting said sheet material, the method comprising the operations of:

producing a precursor of wrapper constituted by said sheet material with at least one product received in said precursor of wrapper;

receiving said precursor of wrapper with at least one product inside it in a shuttle comprising a first part for receiving said at least one product received in said precursor of wrapper and at least one second part that grips on a respective part of said precursor of wrapper, said first part and said at least one second part of said shuttle being able to turn with respect to one another about a given axis;

imparting on said first part and on said at least one second part of said shuttle a relative movement of rotation about said given axis so as to produce said at least one fantail-twisted end as a result of the twisting action imparted on said precursor of wrapper resulting from said relative movement of rotation about said given axis; and providing a screw coupling between said first part and said at least one second part of said shuttle so that, during said relative movement of rotation about said axis that produces the formation of said fantail-twisted end, said first part and said at least one second part of said shuttle approach one another so as to compensate for the shortening of said precursor of wrapper resulting from said twisting action.

19. The method according to claim 18, characterized in that it comprises the operations of:

moving said shuttle in a given direction of advance; and imparting on said first part and on said at least one second part of said shuttle said relative movement of rotation about an axis parallel to said given direction of advance.

20. The method according to claim 18, characterized in that it comprises the operations of:

moving said shuttle in a given direction of advance; and imparting on said first part and on said at least one second part of said shuttle said relative movement of rotation about an axis orthogonal to said given direction of advance.

21. The method according to claim 18, characterized in that said precursor of wrapper is constituted by sheet material bent or folded according to a general U-shaped or V-shaped configuration that receives said product in the part with said U-shaped or V-shaped configuration.

22. The method according to claim 18, characterized in that it comprises the operation of producing said precursor of wrapper in the form of a tubular precursor.

23. The method according to claim 18, characterized in that it comprises the operation of producing said precursor of wrapper in the form of hermetic wrapping from a chain of wrappers containing said products wrapped in hermetic conditions.

24. The method according to claim 18, characterized in that it comprises the operations of:

producing a continuous precursor of wrapper constituted by a web of said sheet material that advances with said products received at given distances in said precursor of wrapper; and receiving a stretch of said precursor of wrapper with at least one product inside it in said shuttle.

25. The method according to claim 24, characterized in that it comprises the operation of subjecting to cutting said continuous precursor of wrapper so as to isolate said stretch of said precursor of wrapper received in said shuttle.

26. The method according to claim 18, characterized in that it comprises the operation of providing a plurality of said shuttles, which move in sequence in a direction of advance and are able to receive within them respective precursors of wrapper with respective products within each respective precursor of wrapper.

27. The method according to claim 18, characterized in that it comprises the operation of associating to at least one between said first part and said at least one second part of said shuttle at least one engagement element interacting with a fixed formation during movement of said shuttle for controlling said relative movement of rotation about said axis.

28. The method according to claim 27, characterized in that it comprises the operation of providing said engagement element and said fixed formation, respectively, as a cam-follower and a cam, which can be engaged by said cam-follower.

29. The method according to claim 27, characterized in that it comprises the operation of providing said engagement element and said fixed formation, respectively, as a pinion gear and a toothing, which can mesh with said pinion gear.

30. The method according to claim 29, characterized in that it comprises the operation of providing said pinion gear on the contour of said at least one second part of said shuttle.

31. The method according to claim 18, characterized in that it comprises the operation of mounting, on at least one between said first part and said at least one second part of said shuttle, a motor element for controlling said relative movement of rotation about said axis.

32. The method according to claim 18, characterized in that it comprises the operation of imparting said relative movement of rotation about said axis, keeping said first part of said shuttle substantially fixed and causing said at least one second part said shuttle to rotate about said axis.

33. The method according to claim 18, characterized in that it comprises the operation of providing said screw coupling via tenon parts and complementary threaded cavities carried by said first part and said at least one second part of said shuttle.

34. A method for producing wrappers of sheet material containing a product with at least one fantail-twisted end obtained by twisting said sheet material, the method comprising the operations of:

producing a precursor of wrapper constituted by said sheet material with at least one product received in said precursor of wrapper;

receiving said precursor of wrapper with at least one product inside it in a shuttle comprising a first part for receiving said at least one product received in said precursor of wrapper and at least one second part that grips on a respective part of said precursor of wrapper, said at least one second part of said shuttle being able to turn with respect to said first about a given axis;

imparting on said first part and on said at least one second part of said shuttle a relative movement of rotation about said given axis so as to produce said at least one fantail-twisted end as a result of the twisting action imparted on said precursor of wrapper resulting from said relative movement of rotation about said given axis; and providing said shuttle with a general booklike structure that enables:

an open position, for receiving said precursor of wrapper; and a closed position, in which the precursor of wrapper with a product inside it is gripped in said shuttle.

35. The method according to claim 34, characterized in that it comprises the operation of providing said shuttle with at least one engagement element, which can interact with a fixed formation during movement of said shuttle for producing the passage of said booklike structure between said open position and said closed position.

36. The method according to claim 34, characterized in that it comprises the operation of providing said engagement element and said fixed formation, respectively, as a cam-follower element and a cam.

37. The method according to claim 34, characterized in that it comprises the operation of providing means of elastic return of said booklike structure into at least one between said open position and said closed position.

38. The method according to claim 34, characterized in that it comprises the operations of providing a hinge in said booklike structure and of associating said means of elastic return to said hinge.

39. The method according to claim 34, characterized in that it comprises the operation of providing said at least one second part of said shuttle in the form of distinct elements that separate from one another when said shuttle is in an open position.

40. The method according to claim 34, characterized in that it comprises the operation of providing said at least one second part of said shuttle as a pair of distinct elements that separate from one another when said shuttle is in an open position, so that said shuttle can be opened into said open position in positions of said relative movement of rotation about said given axis separated from one another by 180° or multiples of 180°.

41. The method according to claim 34, characterized in that it comprises the operation of providing said at least one second part of said shuttle as a plurality of wedges of angular width equal to a submultiple of 180°, which separate from one another when said shuttle is in an open position, so that said shuttle can be opened into said open position in positions of said relative movement of rotation about said given axis separated from one another by one or more submultiples of 180°.

42. Apparatus for producing wrappers of sheet material containing a product with at least one fantail-twisted end obtained by twisting said sheet material, the apparatus comprising:

a feed station for producing a precursor of wrapper constituted by said sheet material with at least one product received in said precursor of wrapper;

at least one shuttle for receiving said precursor of wrapper with at least one product inside it; said shuttle comprising a first part for receiving said at least one product received in said precursor of wrapper and at least one second part that grips on a respective part of said precursor of wrapper, said at least one second part of said shuttle being able to turn with respect to said first part, about a given axis; and motor elements for imparting on said first part and on said at least one second part of said shuttle a relative movement of rotation about said given axis so as to produce said at least one fantail-twisted end as a result of the twisting action imparted on said precursor of wrapper resulting from said relative movement of rotation, wherein said shuttle further comprises a screw coupling between said first part and said at least one second part so that, during said relative movement of rotation about said axis that produces the formation of said fantail-twisted end, said first part and said at least one second part of said shuttle approach one another so as to compensate for the shortening of said precursor of wrapper resulting from said twisting action.

43. Apparatus for producing wrappers of sheet material containing a product with at least one fantail-twisted end obtained by twisting said sheet material, the apparatus comprising:

a feed station for producing a precursor of wrapper constituted by said sheet material with at least one product received in said precursor of wrapper;

at least one shuttle for receiving said precursor of wrapper with at least one product inside it; said shuttle comprising a first part for receiving said at least one product received in said precursor of wrapper and at least one second part that grips on a respective part of said precursor of wrapper, said at least one second part of said shuttle being able to turn with respect to said first part, about a given axis; and motor elements for imparting on said first part and on said at least one second part of said shuttle a relative movement of rotation about said given axis so as to produce said at least one fantail-twisted end as a result of the twisting action imparted on said precursor of wrapper resulting from said relative movement of rotation, wherein said shuttle has a general booklike structure that enables:

an open position, for receiving said precursor of wrapper, and a closed position, in which the precursor of wrapper with a product inside it is gripped in said shuttle.

* * * * *